US005743511A

United States Patent [19]

Eichholz et al.

[11] Patent Number: 5,743,511

[45] Date of Patent: Apr. 28, 1998

[54] CONTROL DEVICE FOR A SANITARY FIXTURE

[75] Inventors: Heinz-Dieter Eichholz, Iserlohn; Hans-Jürgen Ludewig, Rintein; Hans-Peter Rudrich, Windischeschenbach, all of Germany

[73] Assignee: Friedrich Grohe AG, Hemer, Germany

[21] Appl. No.: 590,583

[22] Filed: Jan. 24, 1996

[30] Foreign Application Priority Data

Jan. 25, 1995 [DE] Germany ..... 195 02 214.9

[51] Int. Cl.[6] ..... F16K 31/02; E03C 1/05

[52] U.S. Cl. ..... 251/129.04; 4/623

[58] Field of Search ..... 251/129.04, 129.01; 4/623, 304, DIG. 3

[56] References Cited

U.S. PATENT DOCUMENTS 5,086,526 2/1992 Van Marcke ..... 251/129.04 X

FOREIGN PATENT DOCUMENTS

| | | |
|---|---|---|
| 0313162 | 4/1989 | European Pat. Off. . |
| 0501262 | 9/1992 | European Pat. Off. . |
| 3843047 | 6/1989 | Germany . |
| 4218658 | 12/1992 | Germany . |
| 295 00 918 | 4/1995 | Germany . |
| 44 20 335 | 12/1995 | Germany . |
| 8802707 | 6/1990 | Netherlands . |

*Primary Examiner*—Kevin Lee
*Attorney, Agent, or Firm*—Herbert Dubno

[57] ABSTRACT

A sanitary fixture permits a battery to be packaged with a control and evaluation circuit and a proximity detector for automatic control of a valve. The circuit is set at the factory after final testing with the battery in place to an energy-sparing mode which is maintained, e.g. by a sticker over the receiver of the infrared proximity detector. The normal mode is activated by an infrared signal applied when the unit is installed.

20 Claims, 2 Drawing Sheets

CONTROL DEVICE FOR A SANITARY FIXTURE

FIELD OF THE INVENTION

The present invention relates to a control device for a sanitary fixture, especially for the automatic water valve thereof, e.g. for a urinal, shower or toilet.

More particularly, the invention relates to a control device for a :sanitary fixture of the type wherein at least one transmitter and at least one receiver form a proximity sensor, preferably utilizing infrared radiation, for detecting the presence of a user at the sanitary fixture, the detector being connected to a control and evaluating circuit utilizing one or more batteries or accumulators for the electrical energy source.

BACKGROUND OF THE INVENTION

Control devices of the aforedescribed type are utilized for the water valve of wash basins, urinals or the like to turn on the water when a user is present and to turn off the water in the absence of a user or after a certain time. Battery-operated contactless proximity-controlled sanitary fixtures are provided, generally, with one or primary cells as the electrical current source. The latter should have a certain minimum capacity at the time of delivery to an installer and thus such systems may have a limited system-determined shelf life.

The battery for such units can be provided as separate items which accompany the unit since insertion of the battery in the valve and control system package results in activation of the electronic circuitry and a discharge of the battery prior to use. Frequently, therefore, if the battery is installed on manufacture or prior to delivery to the installer, the battery will run down and thus reduce the shelf life of the unit and, indeed, the battery drain may not permit satisfactory shelf lives and transport times for the system. The problem is accentuated with circuitry utilizing infrared sensors since these sensors consume considerable electrical energy at the transmitter once the battery is installed.

By packaging the battery outside the unit, as an accompanying item so that it is installed only when the unit is installed, excessive drain of the battery can be avoided.

However, it is far more convenient to be able to install the battery upon manufacture and to supply the unit with the battery already installed.

It will be understood that it is customary to supply a unit to the installer which has a useful life of some two or three years but that it is not uncommon for systems of this type to be on the shelf and in transport for periods of two years and that results in an unacceptable limitation of the useful life of the battery or requires additional batteries to be supplied, or the use of batteries of greater capacity.

Systems in which these problems are avoided by supplying the batteries separately from the unit have the following disadvantages:

1. The battery-operated contactless valve system cannot be readily tested in its finished form, especially at a location remote from the fabrication site, since it does not contain the battery, or requires the installation of the battery at that time with the problems previously described.
2. The batteries themselves cannot be tested readily.
3. The valve system or the battery casing must be opened at the installation site by the installer, the battery or batteries must be inserted and the assembly closed and resealed. This can involve the danger of insertion of the batteries with polarity reversal or failure of resealing especially when the installer may lack skills otherwise required.

It has also been proposed to provide switches which are capable of isolating the batteries electrically from the circuitry when such switches are provided, the batteries can be installed at the factory. However, this also poses a problem not only because of the not inconsiderable cost of the switches, but also because the switches are additional components which may tend to fail. The switches may not be readily accessible or upon integration of the unit in the sanitary fixture may be inaccessible. If, of course, the switches are allowed to be accessible following installation, there is always the danger that the unit will be turned off inadvertently to the detriment of the intention of potential users.

OBJECTS OF THE INVENTION

It is, therefore, the principal object of the present invention to provide an improved control system of the type described in which the utilization of electrical energy can be reduced.

It is also an object of the invention to provide a simple but reliable method of operating and mounting a control unit of the type described to minimize electrical consumption.

It is also an object of the invention to provide an improved method of and control system for the automatic contactless operation of a sanitary fixture in which an electric power source can be built into the valve unit at the factory but which nevertheless will ensure that this unit has a satisfactory shelf life and minimum loss of shelf life by reason of electric current drain in the control circuitry.

SUMMARY OF THE INVENTION

These objects are achieved, in accordance with the invention, by providing the control and evaluating circuitry of a system preferably using an infrared transmitter and receiver as the proximity detector and one or more batteries or accumulators as the electrical energy source, with an energy-sparing or sleep mode, in which the energy-sparing mode can be turned on at least by the manufacturer and the normal operating mode is activated at least by the installer and/or end user. More particularly, the control device for a sanitary fixture can comprise:

- a detection unit responsive to presence of a user of a sanitary fixture and including at least an electrically operated transmitter and a receiver responsive to signals from the transmitter;
- a control and evaluating circuit connected to the detection unit for controlling electrical energization thereof and evaluating an output from the receiver for operating the sanitary fixture in a normal mode of operation;
- an electric energy source packaged with the unit and the circuit and connected to the circuit for supplying electrical energy for the detection unit and the circuit; and
- means connected with the circuit and defining an energy-sparing mode of operation thereof and responsive to initiation of the energy-sparing mode of operation by a fabricator of the device for operating the circuit and the unit at low drain of the source substantially below a current drain during the normal mode and responsive to activation upon installation of the device for operation thereof in the normal mode.

According to a method aspect of the invention, in the final assembly of the valve system, the required battery or batteries are installed for the electrical energy supply and the final test is carried out with this energy source in place. The control and evaluation circuitry is then activated to operate in the sleep mode, i.e. the energy-saving mode, assuming that the test showed the system to be satisfactory, and the unit including the battery or batteries is then packaged. Storage and/or transportation to the distribution site and/or a potential installation site can follow.

After removal of the packaging and the installation of the valve for the sanitary fixture at the site of use, the energy-sparing mode is deactivated and the normal operating mode is initiated. Specifically, therefore, the method of installing and operating the sanitary fixture can comprise the steps of:

(a) at a location remote for an installation site, fabricating a control device for a sanitary fixture by packaging together a detection unit responsive to presence of a user of a sanitary fixture and including at least an electrically operated transmitter and a receiver responsive to signals from the transmitter, a control and evaluating circuit connected to the detection unit for controlling electrical energization thereof and evaluating an output from the receiver for operating the sanitary fixture in a normal mode of operation, and an electric energy source connected to the circuit for supplying electrical energy for the detection unit and the circuit;

(b) after the packaging in step (a) subjecting the device to final tests using the source to supply electric current thereto;

(c) upon finding the device to satisfy the tests, activating an energy-sparing mode of operation of the circuit for operating the circuit and the unit at low drain of the source substantially below a current drain during the normal mode;

(d) thereafter packing the device as a finished product, storing the packed device and shipping the packed device to the installation site;

(e) removing packing from the device at the installation site;

(f) thereafter installing the device at the site; and (g) then deactivating the energy-sparing mode of operation of the circuit and initiating the normal mode.

According to a feature of the invention, the control and evaluating circuit has a microprocessor with a rest current consumption in the energy-sparing mode of operation of about 0.3 to 1.0 microamperes and about 100th of the current drain during the normal mode.

The control and evaluating circuit can have a microprocessor with a power-down mode and interrupt control of the power-down mode.

Means can be connected to the control and evaluating circuit for user switch-over selectively between the energy-sparing mode and the normal mode. According to another feature of the invention the energy-sparing mode is maintained at least in part by shielding of at least the receiver of the sensor unit, i.e. by masking it with a member which is opaque to radiation to which the receiver is sensitive, i.e. the infrared radiation. The mask can be an adhesive strip.

According to another feature of the invention the control and evaluating circuit is programmed to respond to a predetermined signal after a delay time to initiate the energy-sparing mode, thereby terminating activity of the circuit except for monitoring an input at the receiver, the circuit being activated to normal mode by application of a sufficient infrared level at the receiver.

The delay can be about 60 seconds and the application of the sufficient infrared level at the receiver may be the application of daylight to the receiver or the light from the striking of a match in the region of the receiver.

Alternatively the control and evaluating circuit is programmed to respond to a direct reflection of light from the transmitter to the receiver after a delay time to initiate the energy-sparing mode, thereby terminating activity of the circuit except for monitoring an input at the receiver, the circuit being activated to normal mode by application of a sufficient infrared level at the receiver.

The control and evaluating circuit can be programmed to switch-over between modes automatically by evaluation of infrared light in a region of the detection unit and after comparison thereof with software provided intensity levels.

The transmitter, as noted, is an infrared light emitter and the receiver an infrared sensitive light detector, and the valve is an electrically operable valve connected to the circuit and operable thereby to cause water flow to the fixture. The system described, in accordance with the invention, has the advantage that the battery can be installed at the factory so that the problems involved with installing the battery need not be met by the initial user. Rather the battery is present with the final testing of the valve and its circuitry. The installed unit is thus a fully integrated component.

The testing of the entire system including the battery can also be made subsequently. There is no need for mechanical intervention of the installer or end user of the housing of the valve or the battery casing as would be required if the battery had to be installed at the time of installation. There is no significant deterioration of the active battery life even with long-term storage and transportation.

The invention enables the supplier to provide a unit with a minimum battery life independent of storage time. There is no danger of reversal of polarity upon battery insertion upon installation and no problem with sealing.

The absence of a mechanical switch for interruption of current supply avoids problems with this additional component. Finally installation of the entire unit upon removal of the packaging can be rapid.

The end user or installer need not be concerned with battery life or battery installation.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
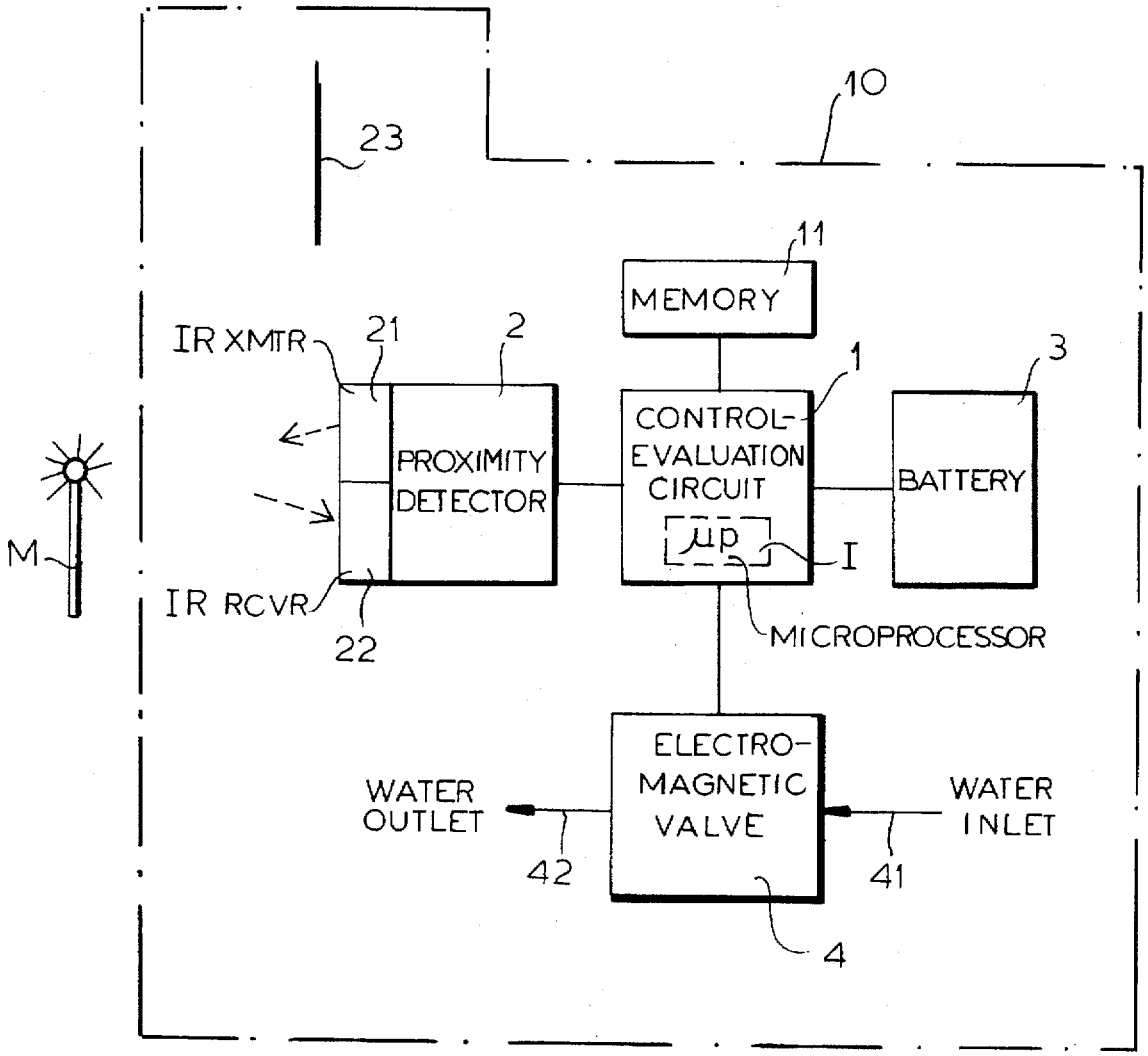
FIG. 1 is a block diagram of the system of the invention.

The, sanitary fixture shown in FIG. 1 of the drawing is illustrated as contained within a package 10, it being understood that the unit shown within the package is assembled at the factory, complete with the battery 3, is tested at the factory, is provided with the IR-opaque mask 23 in the form of an adhesive strip covering the receiver and can be stored and transported as desired. When delivered to the site at which it is to be installed, the receiver 22 can be exposed to IR light, e.g. by removal of the mask 23 or by exposing the receiver to the light from a struck match M to switch the device into its normal mode in which the proximity detector responds to a user to turn on a water flow. The packaged unit has been shown diagrammatically in FIG. 1 and comprises a magnetic valve 4 with a water inlet 41 and a water outlet 42. The magnetic valve 4 is controlled by a control and evaluating circuit 1 and, in the region of the water outlet 42, the detector 2 can be provided to respond to the presence or proximity of a user.

In the normal mode of operation, infrared light signals are produced in the form of IR pulses at an infrared transmitter 21 and reflection of these pulses is detected by the receiver 22. With the contactless detection of the presence of a user indicated by the reflection, the detector 2 generates a signal which is evaluated by the circuit 1 and initiates a water outflow program via a microprocessor μP having an interrupt input I for interrupt control of the microprocessor. The magnetic valve 4, for example, may be opened after a predetermined delay time by an opening pulse from the circuit 1 and the valve 4 is closed after a predetermined period of time by a closing pulse.

The electrical energy for the circuit detector and the valve 4 is supplied by the battery 3 and the circuit and microprocessor or microcontroller can have a memory represented at 11. The entire assembly of the battery 3, the circuit 1 and the detector 2 can be received in the housing of the valve 4.

Figure 2:
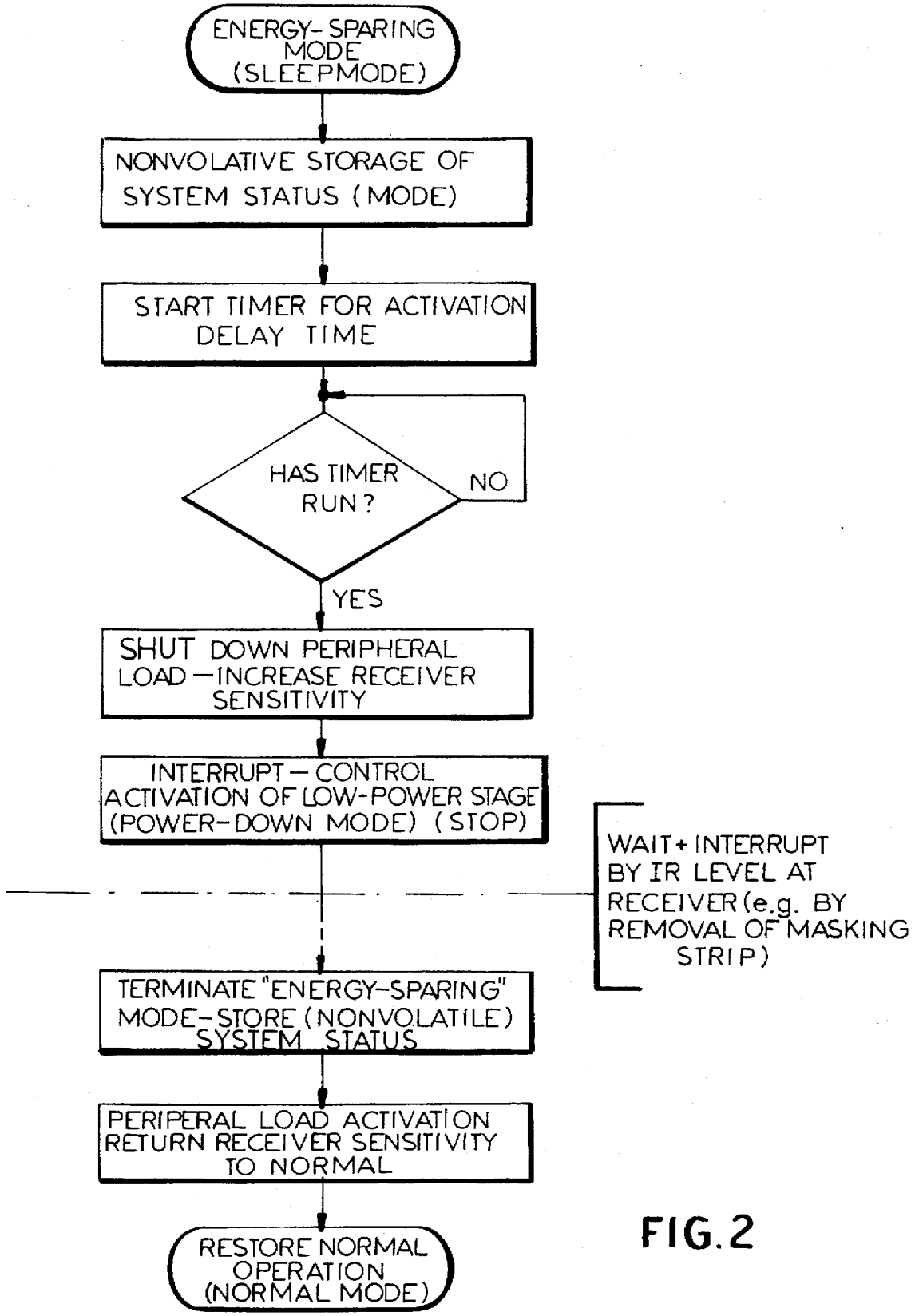
FIG. 2 is a diagram of an algorithm for operating that device.

The energy-sparing operation during storage of the unit shown in FIG. 1 is determined by the system software for the circuit 1 which supplies an energy-sparing mode in which the normal proximity detection program is interrupted and all peripheral loads, for example, the energy-costly transmission of infrared light, with the inclusion of the receiver 22 for the infrared light, are deactivated. Advantageously in this step (see the algorithm of FIG. 2), the receiver sensitivity is increased. The software for the energy-sparing or sleep mode is stored in the module 11.

In the energy-sparing mode the microcontroller or microprocessor unit μP itself is switched to a stand-by mode (either a stop, mode or a power-down mode) which reduces the current drain on the battery for example to 0.3 to 1 microampere or about 100th of the current drain in normal operation.

The output signal of the receiver 22 is applied directly to one input (an interrupt input) of the control and evaluating circuit 1 or is connected thereto via a suitable amplifier/filter circuit.

The energy-sparing or sleep mode is set by the manufacturer with a suitable terminal or input, e.g. a programming device, a remote controller or the like. The latter can draw the sleep-mode program from the memory 11 so that after a defined delay period of, for example, 60 seconds, a power-down of the circuit 1 or the microprocessor to set up the sleep mode is effected.

All operations of the circuit 1 or its microprocessor are thus cut off apart from monitoring the interrupt input or microcontroller port of the receiver 22. To hold the circuit 1 in the energy-sparing mode, a sticker 23 which is opaque to infrared, is applied over the detector device, especially upon the window of the receiver 22.

The reactivation of the normal mode of the circuit 1 is effected by detection of a certain infrared light level exceeding a level threshold determined by the microprocessor at this interrupt I. For these periods, the sticker or mask 23 is removed from the receiver 22. This is done after installation of the valve assembly at the side of use. The switchover from the energy-sparing mode, the sensitivity of the receiver is returned to normal from its enhanced state during the energy-sparing mode and the transmitter begins to send out its infrared light pulses, whereupon the circuit and receiver respond to the presence of a user proximal to the detector. Because of the enhanced sensitivity of the receiver in the energy-sparing mode, normal daylight is usually sufficient to effect switchover from the energy-sparing mode to the normal mode.

During periods of dim light, the activation of the normal mode can be effected by exposing the receiver to an infrared light source, such as candle light, incandescent bulb or, as has been indicated, a struck match M.

The circuit 1 can be mounted and operated as follows.

Initially at the factory during the final assembly, a battery 3 is installed with the circuit 1 and the detector 2 in the housing of the magnetic valve 4. Then the assembly is subjected to the final tests utilizing the power of the battery. When the assembly is found to be satisfactory, the energy-sparing mode is activated by an infrared remote control trained on the receiver 22 and to which the detector 2 is responsive. Within a predetermined delay time, which can be selected at will, e.g. about 60 seconds, the receiver 22 is covered with the sticker 23 of the IR opaque material and the valve assembly is packed at 10 in an infrared opaque packaging. The resulting package can be transported and stored for relatively long periods (see FIG. 2).

Once the unit has been delivered to the construction site, the packaging and/or the sticker 23 are removed from the detector 22 so that with the first detection of sufficient infrared light, e.g. infrared light above a certain threshold intensity, the receiver 22 via the microcontroller interrupt deactivates the energy-sparing mode of the circuit 1 and activates the normal operating mode. The fixture can then operate with normal proximity detection.

The installer requires no particular knowhow or any auxiliary device to switchover from the sleep mode to the normal mode.

Through use of the nonvolatile memory of the circuit 1 for parameter storage, a circuit 1 once having its energy-sparing mode activated can receive a replacement battery during an activation period delay. A "power-on reset" of the circuit 1 can return the device to the energy-sparing mode as long as the microcontroller interrupt does not receive an adequate infrared intensity.

The energy-sparing mode can be activated and deactivated as often as desired and can be maintained by application of the sticker. It can be used for a demonstration of the functions for schooling, display, etc. For example, the system allows the energy-sparing mode to be reactivated when the unit is not to be used for long periods of time and it is desirable to conserve battery power.

Alternatively, the circuit can be so programmed that it is level-selective. For example, the receiver can respond to reflection of the infrared transmitted signal from a reflector (see German Patent 44 20 335) to activate the energy-sparing mode. The energy-sparing mode can also be responsive to the application of the infrared light for a certain period of time t about a defined level. This can be supplied by holding a mirror or other high-grade reflective object in front of the detecting device for a minimum time period.

Finally, the circuit can be so programmed that it itself evaluates the ambient infrared radiation to effect an automatic activation or deactivation of the energy-sparing mode. This can be utilized to allow a period of probable nonuse, for example, night time or twilight periods to be detected with automatic activation of the energy-sparing mode or reactivation of the normal mode.

We claim:

1. A control device for a sanitary fixture comprising:

a detection unit responsive to presence of a user of a sanitary fixture and including at least an electrically operated transmitter and a receiver responsive to signals from said transmitter;

a control and evaluating circuit connected to said detection unit for controlling electrical energization thereof and evaluating an output from said receiver for operating the sanitary fixture in a normal mode of operation;

an electric energy source packaged with said unit and said circuit and connected to said circuit for supplying electrical energy for said detection unit and said circuit;

means connected with said circuit for activating an energy-sparing mode of operation of said device in response to initiation of said energy-sparing mode of operation by a fabricator of the device; and means for operating said circuit and said unit in said energy-sparing mode at low drain of said source substantially below a current drain during said normal mode, said energy-sparing mode being deactivated upon installation of the device for operation thereof in said normal mode.

2. The control device for a sanitary fixture defined in claim 1 wherein said control and evaluating circuit has a microprocessor with a rest current consumption in said energy-sparing mode of operation of about 0.3 to 1.0 microampere and about one hundredth of the current drain during said normal mode.

3. The control device for a sanitary fixture defined in claim 1 wherein said control and evaluating circuit has a microprocessor with a power-down mode and interrupt control of said power-down mode.

4. The control device for a sanitary fixture defined in claim 1, wherein said means for activating said energy-sparing mode comprises means connected to said control and evaluating circuit for user switchover selectively between said modes.

5. The control device for a sanitary fixture defined in claim 1 wherein said means for operating said circuit and said unit in said energy-sparing mode is constructed to maintain said energy-sparing mode during shielding of at least said receiver of said unit.

6. The control device for a sanitary fixture defined in claim 5, further comprising a removable adhesive mask on said receiver and opaque to radiation to which said receiver is sensitive.

7. The control device for a sanitary fixture defined in claim 1 wherein said control and evaluating circuit is programmed to respond to a predetermined signal after a delay time to initiate said energy-sparing mode, thereby terminating activity of said circuit except for monitoring an input at said receiver, the circuit being activated to normal mode by application of a sufficient infrared level at said receiver.

8. The control device for a sanitary fixture defined in claim 7 wherein said delay is about 60 seconds.

9. The control device for a sanitary fixture defined in claim 7 wherein the application of a sufficient infrared level at said receiver is the application of daylight to said receiver.

10. The control device for a sanitary fixture defined in claim 7 wherein the application of a sufficient infrared level at said receiver is the striking of a match.

11. The control device for a sanitary fixture defined in claim 1 wherein said control and evaluating circuit is programmed to respond to a direct reflection of light from said transmitter to said receiver after a delay time to initiate said energy-sparing mode, thereby terminating activity of said circuit except for monitoring an input at said receiver, the circuit being activated to normal mode by application of a sufficient infrared level at said receiver.

12. The control device for a sanitary fixture defined in claim 1 wherein said control and evaluating circuit is programmed to switchover between said modes automatically by evaluation of infrared light in a region of said detection unit and after comparison thereof with software-provided intensity levels.

13. The control device for a sanitary fixture defined in claim 1 wherein said transmitter is an infrared light emitter and said receiver is responsive to infrared light.

14. The control device defined in claim 1, further comprising an electrically operable valve connected to said circuit and operable by said circuit to cause water flow to said fixture.

15. The control device defined in claim 1 wherein said source is at least one battery.

16. A method of installing and operating a sanitary fixture, comprising the steps of:

(a) at a location remote for an installation site, fabricating a control device for a sanitary fixture by packaging together a detection unit responsive to presence of a user of a sanitary fixture and including at least an electrically operated transmitter and a receiver responsive to signals from said transmitter, a control and evaluating circuit connected to said detection unit for controlling electrical energization thereof and evaluating an output from said receiver for operating the sanitary fixture in a normal mode of operation, and an electric energy source connected to said circuit for supplying electrical energy for said detection unit and said circuit;

(b) after said packaging in step (a) subjecting said device to final tests using said source to supply electric current thereto;

(c) upon finding said device to satisfy said tests, terminating the normal mode of operation of said device and thereafter activating an energy-sparing mode of operation of said circuit for operating said circuit and said unit at low drain of said source substantially below a current drain during said normal mode;

(d) thereafter packing said device as a finished product, storing the packed device and shipping the packed device to said installation site;

(e) removing packing from said device at said installation site;

(f) thereafter installing said device at said site; and (g) then deactivating said energy-sparing mode of operation of said circuit and initiating said normal mode.

17. The method defined in claim 16 wherein the activating of said energy-sparing mode of operation of said circuit in step (c) includes placing an adhesive mask over said receiver, said receiver being sensitive to infrared light.

18. The method defined in claim 17 wherein the deactivating of said energy-sparing mode of operation of said circuit and initiating said normal mode in step (g) includes removing said adhesive mask from said receiver.

19. The method defined in claim 18 wherein the deactivating of said energy-sparing mode of operation of said circuit and initiating said normal mode in step (g) includes exposing said receiver to daylight.

20. The method defined in claim 18 wherein the deactivating of said energy-sparing mode of operation of said circuit and initiating said normal mode in step (g) includes exposing said receiver to light from a striking of a match.

* * * * *